US007140705B2

(12) United States Patent
Dressendorfer et al.

(10) Patent No.: US 7,140,705 B2
(45) Date of Patent: Nov. 28, 2006

(54) INFINITELY ADJUSTABLE MODULE ROW DIVIDER FOR A CABINET DRAWER

(75) Inventors: Michael R. Dressendorfer, San Dimas, CA (US); Peter C. Wilson, Whittier, CA (US)

(73) Assignee: Russ Bassett Corporation, Whittier, CA (US)

( * ) Notice: Subject to any disclaimer, the term of this patent is extended or adjusted under 35 U.S.C. 154(b) by 0 days.

(21) Appl. No.: 10/053,118

(22) Filed: Jan. 24, 2002

(65) Prior Publication Data

US 2002/0145369 A1 Oct. 10, 2002

Related U.S. Application Data

(60) Provisional application No. 60/282,615, filed on Apr. 9, 2001.

(51) Int. Cl.
*A47B 88/00* (2006.01)

(52) U.S. Cl. ..... 312/348.3; 312/183; 312/348.5; 211/184

(58) Field of Classification Search ..... 312/348.3, 312/348.5, 9.43, 9.44, 9.55, 183; 220/529, 220/534, 544, 545, 549; 211/183, 184, 43, 211/46

See application file for complete search history.

(56) References Cited

U.S. PATENT DOCUMENTS

| | | | | | |
|---|---|---|---|---|---|
| 1,940,048 | A | * | 12/1933 | Cutler | 312/304 |
| 3,675,781 | A | * | 7/1972 | Chamberlin | 211/11 |
| 3,726,411 | A | * | 4/1973 | Jones | 211/126.13 |
| 3,892,451 | A | * | 7/1975 | Bruins | 312/348.3 |
| 4,102,470 | A | * | 7/1978 | Timmons | 220/543 |
| 4,125,299 | A | * | 11/1978 | Chamberlin | 312/184 |
| 5,111,959 | A | * | 5/1992 | Glickman | 220/544 |
| 5,269,600 | A | * | 12/1993 | Arreola et al. | 312/348.3 |
| 5,366,283 | A | * | 11/1994 | Crose | 312/183 |
| 5,826,956 | A | * | 10/1998 | Norton | 312/183 |
| 6,460,710 | B1 | * | 10/2002 | Dardashti | 211/184 |

FOREIGN PATENT DOCUMENTS

DE 19963847 A1 * 7/2001

* cited by examiner

*Primary Examiner*—Ramon O. Ramirez
*Assistant Examiner*—Amy J. Sterling
(74) *Attorney, Agent, or Firm*—Kenneth L. Green; Edgar W. Averill, Jr.

(57) ABSTRACT

A cabinet drawer (12–20) for storing information modules (22) of selectively different widths in rows extending front to back of the drawer has row dividers (24) which are removably end mounted within slots (50,52) at any desirable width spacing. The dividers each have a flexible center portion (54) terminating in pedestals (56,58) for receipt within the slots (50,52). When dividers are so-mounted within a drawer (12–20) they are secured in place by inherent spring characteristics of the divider (24).

3 Claims, 2 Drawing Sheets

INFINITELY ADJUSTABLE MODULE ROW DIVIDER FOR A CABINET DRAWER

This application claims the benefit of U.S. Provisional Application No. 60/282,615 filed Apr. 9, 2001.

BACKGROUND

1. Background of the Invention

The present invention relates generally to a cabinet drawer for efficiently storing information modules, and, more particularly, to an infinitely adjustable drawer module row divider enabling efficient storage of different sized modules within the same drawer.

2. Description of Related Art

Storage devices for information are being provided in increasingly different sizes and shapes and most businesses are confronted with the use and storage of at least several different kinds of such devices in an efficiently retrievable manner. Illustrative of but some of the many information storage devices being utilized at the present time are the following, each one having its own distinctive dimensions: D2-Large; 3/4 U Matic; Beta Large; 5.25 Optical Disc; DVD Album; CD/DVD Jewel Case; D2 Small; VHS Box; Beta Small; DLT Box; VHS Sleeve; Beta Small Sleeve; 3.5 Optical Disc; DV CAM Large; DVC PRO Large; 4MM; DV CAM Small; DVC PRO Small; Audio; 8MM.

Although many cabinet arrangements are available which are specifically designed for storage and ready retrieval of particular information storage devices, before now there have been no cabinet arrangements that would fully satisfactorily accommodate a wide range of different-sized storage devices within the same drawer and could be readily modified to accommodate changes in the modules stored in any one or more drawers.

SUMMARY OF INVENTION

It is a primary object and aim of the present invention to provide an improved cabinet assembly for storage of information devices or modules of varying dimensions.

Another object as in the previous object is the provision of the ability of a cabinet to accommodate one or more drawers into which information modules of different dimensions can be efficiently stored.

Yet another object as in the previous objects is the provision of a drawer divider that is infinitely adjustable to quickly define rows of selectively predetermined dimensions.

In accordance with the practice of the present invention, an information storage module cabinet assembly includes a plurality of internal drawer hanger means mounted on facing side walls which typically adapt to receive one or a plurality of drawers which can be of the same size or different sizes. The drawers irrespective of the collection of sizes being assembled into the cabinet present a contiguous smooth outer surface with no gapping between adjacent drawers.

A drawer is constructed with a pair or slotted openings, one in the back wall and one in the front wall, that extend throughout the drawer width and substantially parallel to one another. A module row divider includes a flexible body of springlike characteristics having opposite end portions which can be received respectively within the pair of slotted openings. The divider end portions may be adjustably positioned within the stored openings to provide any desired width for accommodating particular information modules of corresponding widths. The springlike characteristics of the divider also permit removal by mere hand transverse flexing of the divider body and lifting out from the slotted openings.

BRIEF DESCRIPTION OF THE DRAWING

The above-recited and other objects and aims of the invention will become more readily apparent upon referencing the following detailed description and upon examining the attached drawing in which.

DESCRIPTION OF PREFERRED EMBODIMENTS

Figure 2:
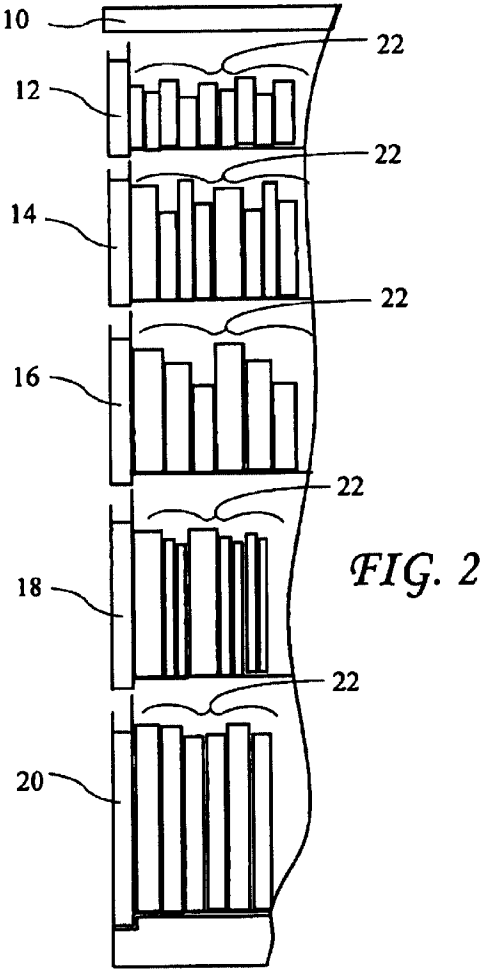
FIG. 2 is a side elevational sectional view of the cabinet of FIG. 1 shown accommodating different information modules.
Figure 1:
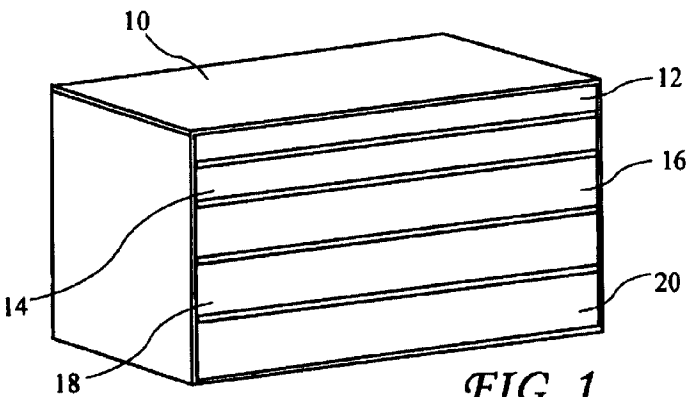
FIG. 1 is a perspective view of a cabinet including a number of pullout drawers.
Figure 3:
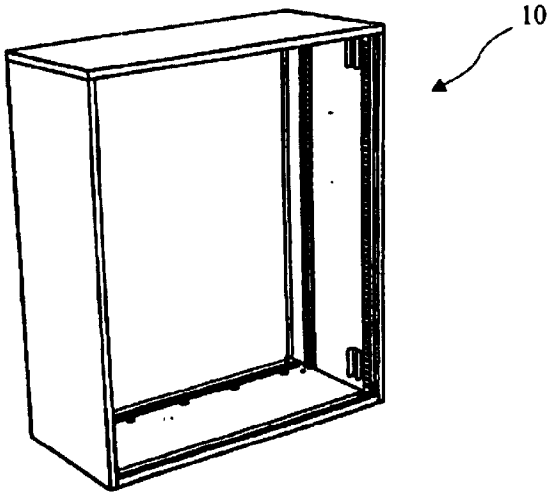
FIG. 3 is a perspective view of an empty cabinet housing as seen through an open side with the drawers removed.

With reference now to the drawing and particularly FIGS. 1 and 2, a drawer cabinet 10 of the invention is depicted having a plurality of horizontally extendible drawers 12, 14, 16, 18 and 20, shown for illustrative purposes as having different vertical dimensions or heights, although they can also be of identical dimensions. As can be seen best in FIG. 2, the drawers for information modules have a front height dimension ranging from 4 inches to 8 inches for accommodating relatively small to large information modules 22, which although enumerated by a single number refer to a large number of different-sized items. The modules are of generally parallelepiped geometry, but otherwise can differ considerably in thickness, width and length. It is a fundamental feature of the invention to utilize individual drawer space as economically as possible and, in that way, also result in efficient use of available room space taken up by the cabinet.

Although the different drawers depicted in FIG. 1 increase in width from the top to the bottom of the cabinet, it may be advisable to have other arrangements. For example, in a particular business facility certain sizes of information modules may predominate over others and, therefore, depending upon the cabinet height specifically sized drawers for most frequently retrieved modules may be located at a more convenient height than others. Accordingly, depending upon frequency of use, cabinet drawer size arrangements can be provided to suit any ergonomic pattern.

Figure 4:
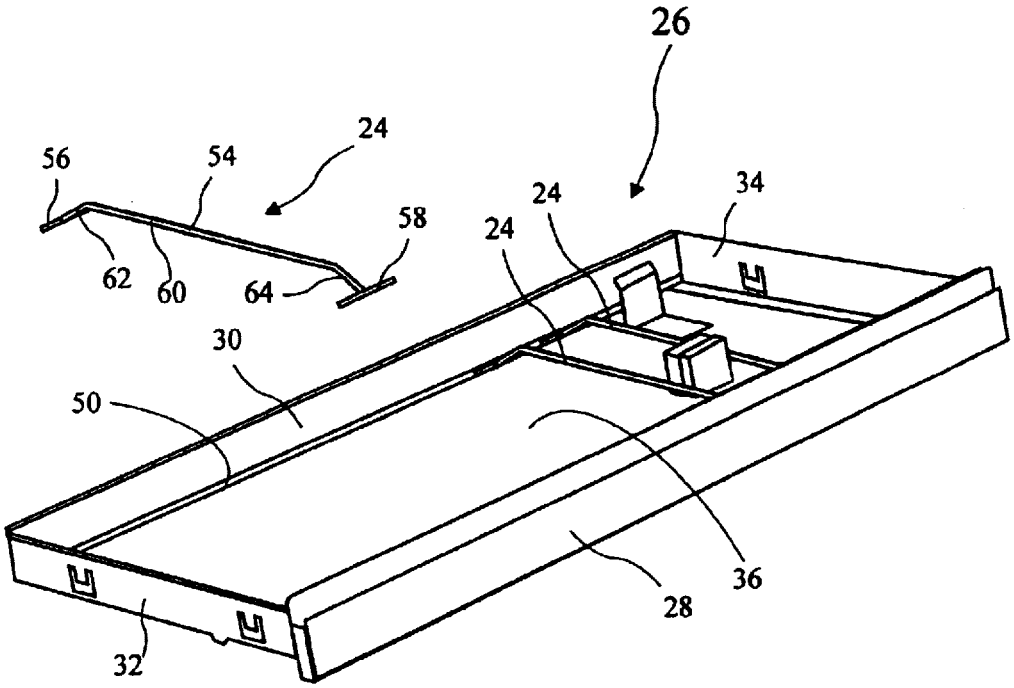
FIG. 4 is a perspective view of a drawer frame for accommodating an adjustable module row divider of the invention.
Figure 5:
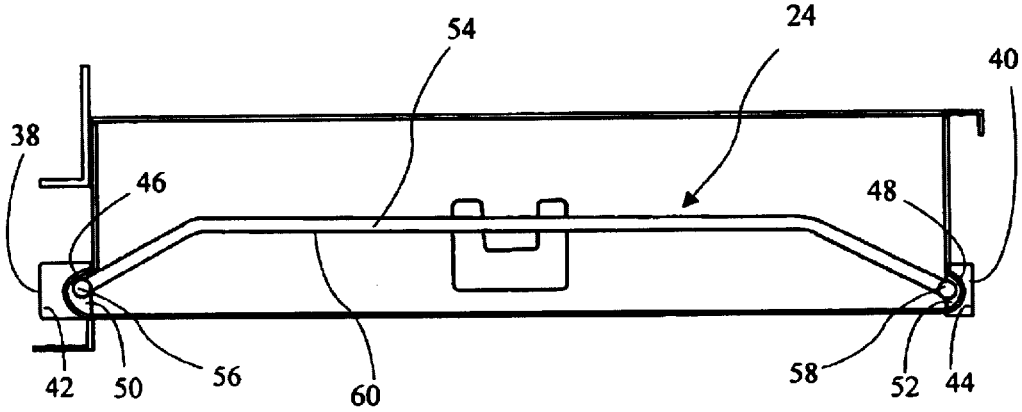
FIG. 5 is an end sectional view of a drawer frame and module row divider taken along the line 5—5 of FIG. 4.

For the ensuing description of a module drawer divider 24 of this invention, reference is now made to both FIGS. 4 and 5. A drawer frame 26 includes respectively generally rectangular front, back and first and second end panels 28, 30, 32 and 34, preferably constructed of metal. The frame will be described here as contemplated for mounting within an outer drawer framework constructed of wood or other material finished off with an aesthetically pleasing outer surface. However, by proper modification the metal frame can have its outer surface adapted to be part of an overall metal cabinet.

A bottom panel 36, which also serves as a drawer bottom, is suitably secured to the front and back panels 28 and 30 by welding, for example. More particularly, as shown best in FIG. 5 the lowermost edge portions 38 and 40 of the front and back panels are formed into respective recessed channels 42 and 44 that extend substantially entirely from the first end panel to the second end panel and open toward each other. In addition, the front and back edge portions of the bottom panel 36 are turned back somewhat onto the same major surface of the bottom panel forming curved edges 46 and 48, each having an elongated slot 50 and 52 facing one another. The bottom panel and edges 46 and 48 are so-dimensioned that on assembly the curved edges individually fit within the recessed channels 42 and 44.

The modular drawer divider 24 is constructed of a relatively heavy steel wire (e.g., 0.250 inches in diameter) having springlike characteristics. As to major constructional features, the divider includes an elongated center portion 54 with first and second identical feet or pedestals 56 and 58 unitarily related to opposite ends of the center portion. More particularly, the center portion 54 has a generally straightline part 60 with opposite end portions 62 and 64 angularly canted from 60 on the same side thereof and all lying in a single plane. Each pedestal 56 and 58 is rigidly secured to a termination of an end portion 62 and 64 so as to extend at approximately 90-degrees thereto. A satisfactory method of securement of the pedestals to the center portion is by welding.

For assembly, one pedestal 56, 58 of the divider 24 is positioned within the elongated slot 50 at the front edge portion of the drawer frame with the remainder of the divider extending slightly upwardly out of the frame. The divider center portion 54 is now flexed sufficiently so that the free pedestal can be fitted within the slot 52 at the back of the frame. The divider is now fixedly positioned within the two slots so as to form a lateral wall or limit of a row for confining information modules. If it is necessary or desirable to change module row width, the process is merely reversed and the divider relocated. Any desired number of dividers can assembled into a drawer frame to provide a plurality of rows for storing modules, all of the same row width or of varying width in order to accommodate modules of correspondingly different widths.

In accordance with the practice of the described invention, a cabinet is provided with one or a plurality of drawers of same or different heights for accommodating the storage of information modules of correspondingly different sizes. Moreover, each drawer is provided with removable and dimensionally adjustable lateral row dividers for efficiently arranging appropriately different-sized modules within a drawer. Still further, an assembled row divider may be quickly and easily removed and reassembled at a different location to provide a modified row width.

Although the present invention is described in connection with a preferred embodiment, it is to be understood that those skilled in the appertaining arts may contemplate modifications that come within the spirit of the invention as described and within the ambit of the appended claims.

What is claimed is:

1. A drawer for efficiently storing a plurality of generally parallel piped geometry modules of predetermined dimensions, said drawer having front, bottom, back and opposite side panels, comprising:

means forming a first slot extending along the back panel and facing toward the front panel;

means forming a second slot extending along the front panel and facing toward the back panel, said second slot being spaced from said first slot;

at least one drawer row divider having a first end portion removably positioned within the first slot and a second end portion received within the second slot with a flexible wire portion between the first and second end portions extending outwardly from the bottom panel within the drawer containing space separating adjacent rows of modules; and said divider end portions each including a generally straightline wire pedestal secured to the divider intervening portion and extending transversely of said intervening portion, said wire pedestals being respectively positioned within the first and second slots and held at a specific position therein by spring characteristics of the intervening portion of the wire.

2. A drawer as in claim 1, in which the drawer bottom panel has both h a front edge portion and a back edge portion formed partially back over the bottom panel facing toward each other forming the first and second slots.

3. A drawer as in claim 2, in which the pedestal is affixed to the divider intervening portion by a weldment.

* * * * *